US008857918B2

(12) United States Patent
Chiang

(10) Patent No.: US 8,857,918 B2
(45) Date of Patent: Oct. 14, 2014

(54) CUTTING TOOL HOLDING DEVICE

(71) Applicant: Everpads Co., Ltd., Taichung (TW)

(72) Inventor: Chun-Li Chiang, Taichung (TW)

(73) Assignee: Everpads Co., Ltd., Taichung (TW)

( * ) Notice: Subject to any disclaimer, the term of this patent is extended or adjusted under 35 U.S.C. 154(b) by 0 days.

(21) Appl. No.: 13/762,382

(22) Filed: Feb. 8, 2013

(65) Prior Publication Data

US 2013/0207444 A1 Aug. 15, 2013

(30) Foreign Application Priority Data

Feb. 13, 2012 (TW) ..... 10120255 A

(51) Int. Cl.
*E21C 35/197* (2006.01)
*E21C 35/193* (2006.01)
*E21C 35/183* (2006.01)

(52) U.S. Cl.
CPC ..... *E21C 35/183* (2013.01); *E21C 35/193* (2013.01)
USPC ..... 299/104

(58) Field of Classification Search
USPC ..... 299/104
See application file for complete search history.

(56) References Cited

U.S. PATENT DOCUMENTS

| | | | | |
|---|---|---|---|---|
| 4,337,980 A * | 7/1982 | Krekeler | 299/102 |
| 4,678,238 A * | 7/1987 | Emmerich | 299/107 |
| 4,915,454 A * | 4/1990 | Southern | 299/108 |
| 5,607,206 A * | 3/1997 | Siddle et al. | 299/102 |

* cited by examiner

*Primary Examiner* — John Kreck
(74) *Attorney, Agent, or Firm* — CKC & Partners Co., Ltd.

(57) ABSTRACT

A cutting tool holding device includes a base, a positioning tube and a positioning member. The base includes a mounting hole and a through hole, and the through hole is formed at a side of the mounting hole and communicated with the mounting hole. The positioning tube includes an axial receiving hole, an accommodated portion and a limiting groove. The axial receiving hole is formed within the positioning tube for receiving a cutting tool. The accommodated portion is disposed at an end of the positioning tube for being installed into the mounting hole. The limiting groove is formed on a side of the accommodated portion. The positioning member is positioned in the through hole of the base, wherein the positioning member abuts against the limiting groove of the positioning tube.

10 Claims, 15 Drawing Sheets

CUTTING TOOL HOLDING DEVICE

RELATED APPLICATIONS

The application claims priority to Taiwan Application Serial Number 101202555 filed Feb. 13, 2012, which is herein incorporated by reference.

BACKGROUND

1. Technical Field

The present disclosure relates to a holding device. More particularly, the present disclosure relates to a cutting tool holding device.

2. Description of Related Art

A cutting tool holding device for receiving a cutting tool is configured to be attached to a road planer for cutting, mining, excavating the ground or applying a surface roughness treatment to a road. Conventionally, a cutting tool holding device includes a base and a cutting tool holder for receiving a cutting tool. The base is fixed on a peripheral surface of a working member (such as a roller) of a machinery (such as a road planer), and the cutting tool holder is engaged with the base. The engagement of the cutting tool holder and the base is usually fixed by some fastening members, e.g., screws. The cutting tool received in the cutting tool holder is mounted along a tangent of the base for facilitating the excavating or cutting operations applied to the ground. In the working process of the aforementioned machinery, a excavating operation is first applied to a processed material (such as concrete or asphalt over a road) by the cutting tool; as the roller rotates, a cutting operation is then applied to the ground by the cutting tool so as to destroy the processed material.

In general, the processed material is solid and stiff, and thus the cutting tool working on it only has a rather limited lifetime and needs to be frequently replaced. Furthermore, in the working process a reaction force generated from the processed material is not only exerted on the cutting tool, but also on the base and the cutting tool holder. Therefore, when the base and the cutting tool holder are not firmly engaged, serious damages caused by the reaction force occur in the cutting tool holder and the base. As a result, the cutting tool holder and the base are also in need of the frequent replacement. Consequently, the maintenance cost of the cutting tool holding device is high in the art.

Therefore, it is important to reinforce the engagement between the base and the cutting tool holder for prolonging the life span of the cutting tool holding device so as to reduce the maintenance cost thereof.

SUMMARY

According to one aspect of the present disclosure, a cutting tool holding device includes a base, a positioning tube and a positioning member. The base includes a mounting hole and a through hole, and the through hole is formed at a side of the mounting hole and communicated with the mounting hole. The positioning tube includes an axial receiving hole, an accommodated portion and a limiting groove. The axial receiving hole is formed within the positioning tube for receiving a cutting tool. The accommodated portion is disposed at an end of the positioning tube for being installed into the mounting hole. The limiting groove is formed on a side of the accommodated portion. The positioning member is positioned in the through hole of the base, wherein the positioning member abuts against the limiting groove of the positioning tube.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
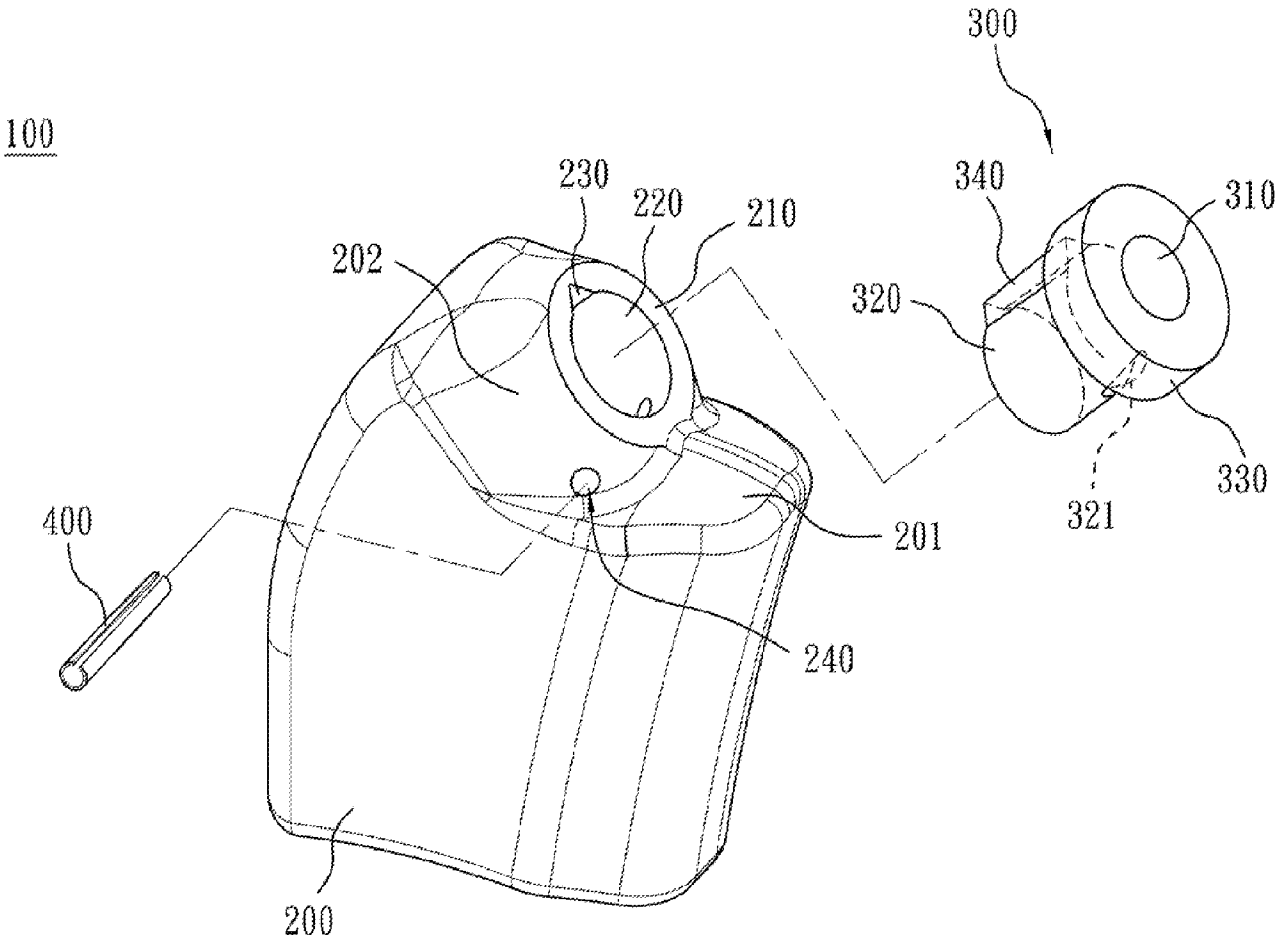
FIG. 1 is an exploded view of a cutting tool holding device according to one embodiment of the present disclosure.
Figure 2:
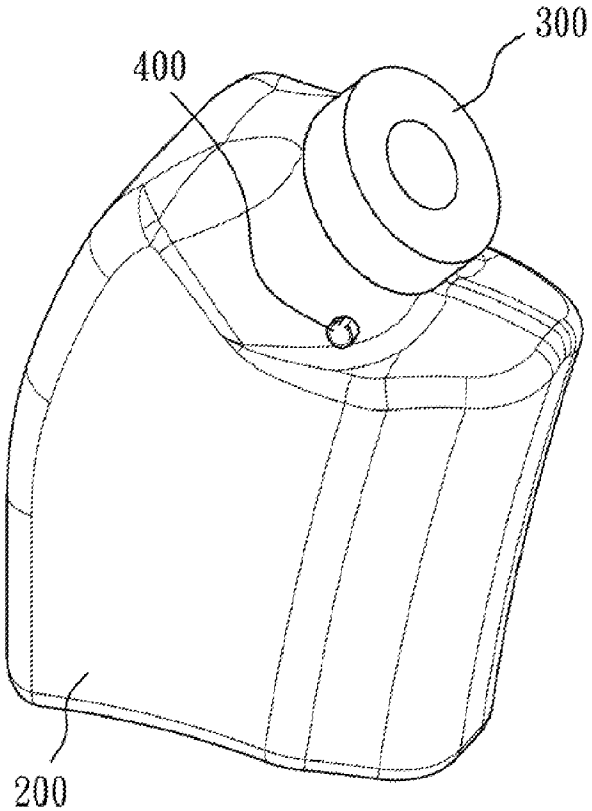
FIG. 2 is a perspective view of the cutting tool holding device shown in FIG. 1.
Figure 3:
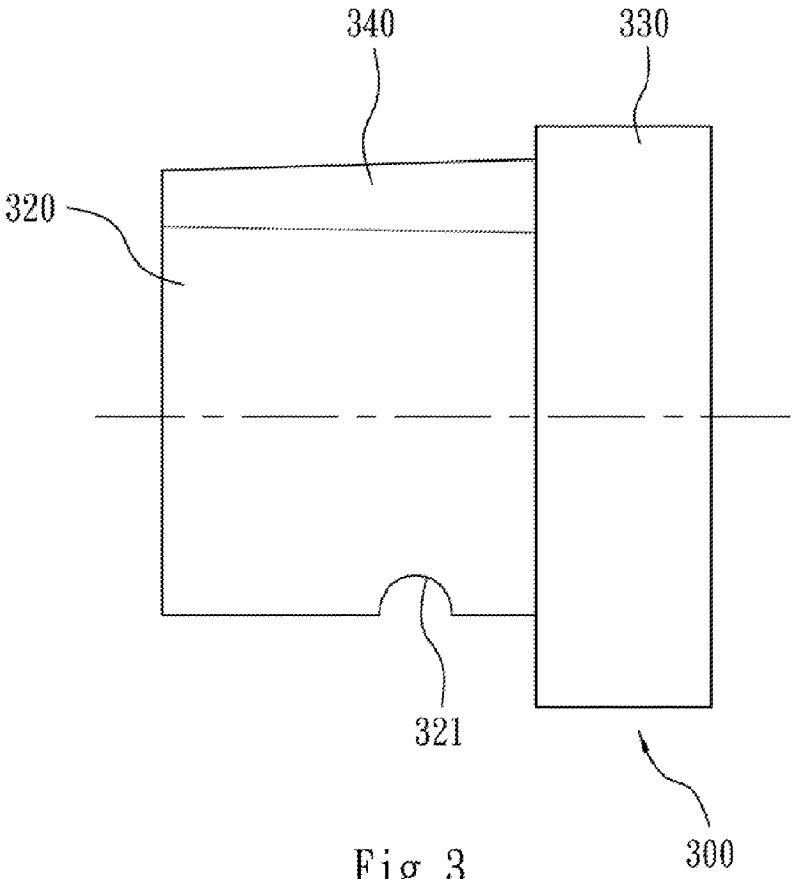
FIG. 3 is a side view of a positioning tube shown in FIG. 1.
Figure 4:
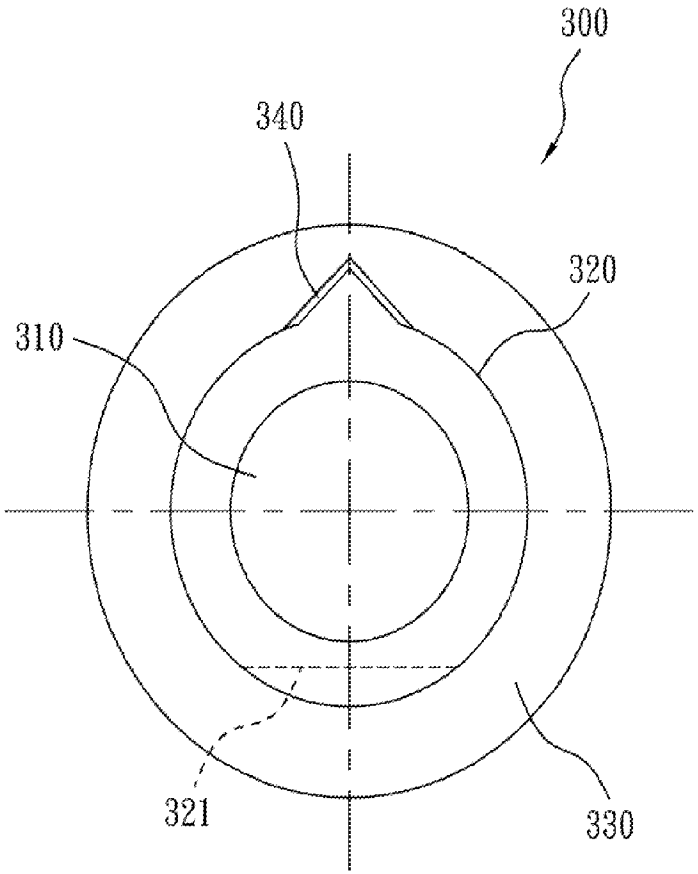
FIG. 4 is a front view of the positioning tube shown in FIG. 3.
Figure 5:
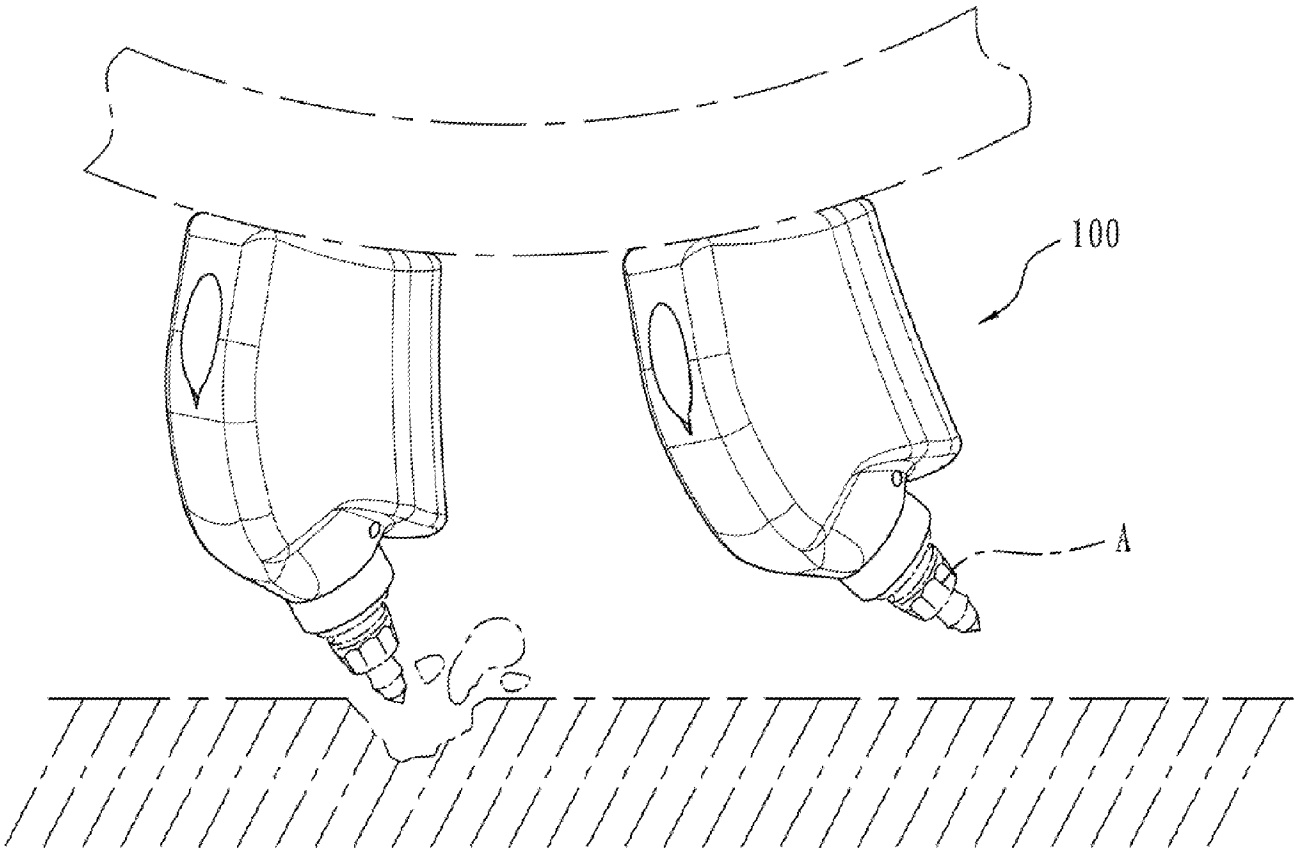
FIG. 5 is an operating schematic view of the cutting tool holding device shown in FIG. 1.

FIG. 1 is an exploded view of a cutting tool holding device 100 according to one embodiment of the present disclosure. FIG. 2 is the perspective view of the cutting tool holding device 100 shown in FIG. 1. FIG. 3 is a side view of a positioning tube 300 shown in FIG. 1. FIG. 4 is a front view of the positioning tube 300 shown in FIG. 3. In FIG. 1, the cutting tool holding device 100 is for receiving a cutting tool A (as shown in FIG. 5). The cutting tool holding device 100 includes a base 200, the positioning tube 300 and a positioning member 400.

The base 200 includes a first wall 201 and a second wall 202. A mounting surface 210 is formed on the second wall 202, and a mounting hole 220 is formed at a center of the mounting surface 210. An axial pressing groove 230 is disposed at an upper side of the mounting hole 220. The axial pressing groove 230 can be formed in a V-shape as illustrated in FIG. 1. A through hole 240 is formed at a lower side of the mounting hole 220, and the through hole 240 is communicated with the mounting hole 220.

The positioning tube 300 has an axial receiving hole 310 formed within the positioning tube 300 for receiving the cutting tool A. An accommodated portion 320 is disposed at an end of the positioning tube 300, and a step portion 330 is disposed at the other end of the positioning tube 300. The step portion 330 abuts against the mounting surface 210 for reinforcing an assembling stability between the base 200 and the positioning tube 300. The accommodated portion 320 is installed into the mounting hole 220. A limiting groove 321 is formed on a side of the accommodated portion 320, and a pressing member 340 corresponding to the axial pressing groove 230 is formed on the other side of the accommodated portion 320. The pressing member 340 is a triangular column corresponding to the axial pressing groove 230 for engaging with the axial pressing groove 230. Furthermore, the pressing member 340 has a cross-sectional area reducing gradually from an inner side of the pressing member 340 to an outer side of the pressing member 340, whereby a tightening degree between the positioning tub 300 and the base 200 increases gradually as the positioning tube 300 is installed into the base 200.

The positioning member 400 is a C-shaped elastic tube, and the positioning member 400 is positioned in the through hole 240 by an expanding elasticity thereof. A portion of the positioning member 400 is limited in the limiting groove 321 and the portion of the positioning member 400 abuts against the limiting groove 321. An extending direction of the axial pressing groove 230 is substantially perpendicular to a through direction of the positioning member 400.

The assembling stability between the base 200 and the positioning tube 300 can be reinforced by the aforementioned assembling relationship between the pressing member 340 and the axial pressing groove 230, and a rotating movement of the positioning tube 300 in the base 200 can be avoided, too. The assembling stability between the base 200 and the positioning tube 300 can be further reinforced by the perpendicular relationship between the extending direction of the axial pressing groove 230 and the through direction of the positioning member 400. The assembling stability between the base 200 and the positioning tube 300 can also be reinforced by the expanding elasticity generated from the positioning member 400. Therefore, a load value of the base 200 and a load value of the positioning tube 300 for a reaction force generated by the cutting tool A can be enhanced, and a displacement of the base 200 caused by the reaction force can be avoided, too.

Figure 14:
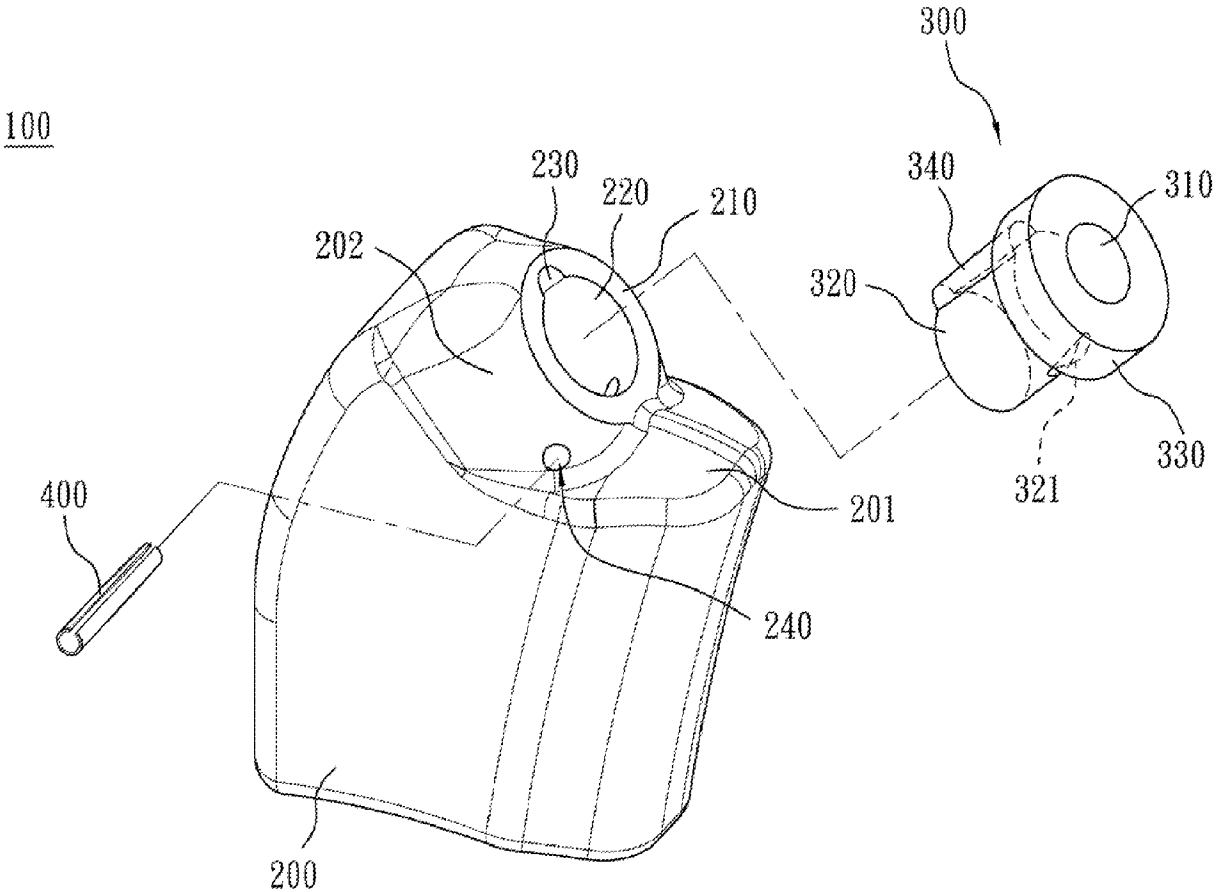
FIG. 14 is an exploded view of a cutting tool holding device according to yet another embodiment of the present disclosure.
Figure 15:
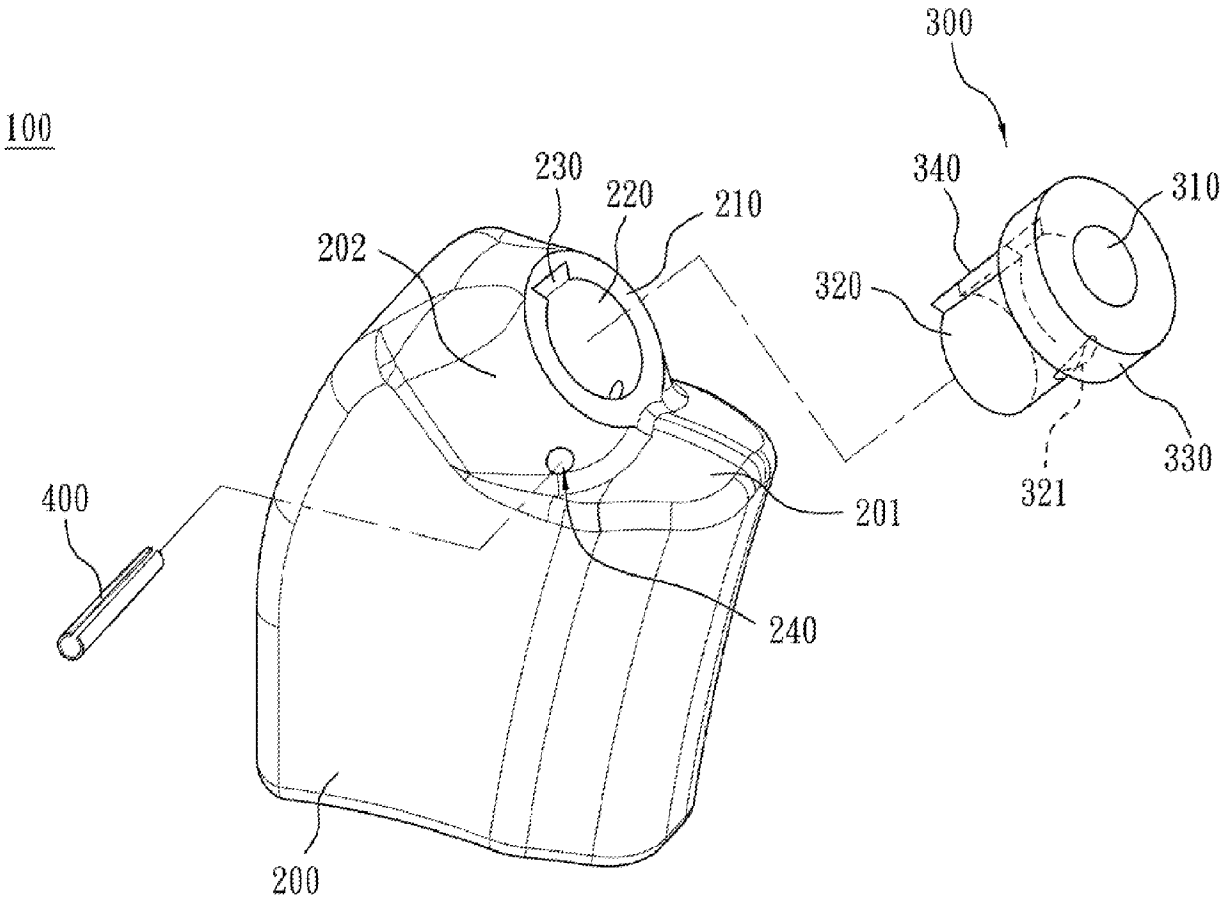
FIG. 15 is an exploded view of a cutting tool holding device according to vet another embodiment of the present disclosure.

FIG. 14 is an exploded view of a cutting tool holding device 100 according to yet another embodiment of the present disclosure. FIG. 15 is an exploded view of a cutting tool holding device 100 according to vet another embodiment of the present disclosure. As shown in FIG. 14 and FIG. 15. The axial pressing groove 230 can be formed in a U-shape or in a dovetail shape, and the pressing member 340 can be a half cylinder or a dovetail column corresponding to the axial pressing groove 230.

In the embodiment, the tightening degree between the positioning tube 300 and the base 200 is increased gradually by the cross-sectional area of the pressing member 340 reducing gradually from an inner side of the pressing member 340 to an outer side of the pressing member 340. In other embodiment, the tightening degree between the positioning tube 300 and the base 200 can be increased gradually by a cross-sectional area of the axial pressing groove 230 reducing gradually from an outer side of the axial pressing groove 230 to an inner side of the axial pressing groove 230.

FIG. 5 is an operating schematic view of the cutting tool holding device 100 shown in FIG. 1. The load value of the base 200 and the load value of the positioning tube 300 for the reaction force can be enhanced. Therefore, the life span of the base 200 and the positioning tube 300 can be prolonged, and the maintenance cost of the cutting tool holding device 100 can be reduced.

Figure 6:
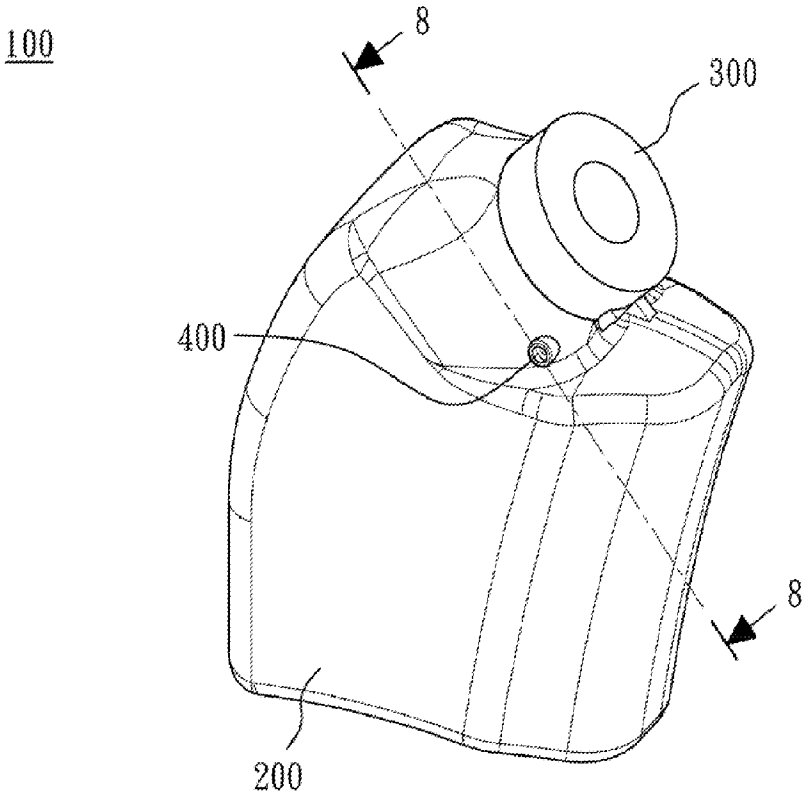
FIG. 6 is a perspective view of a cutting tool holding device according to another embodiment of the present disclosure.
Figure 7:
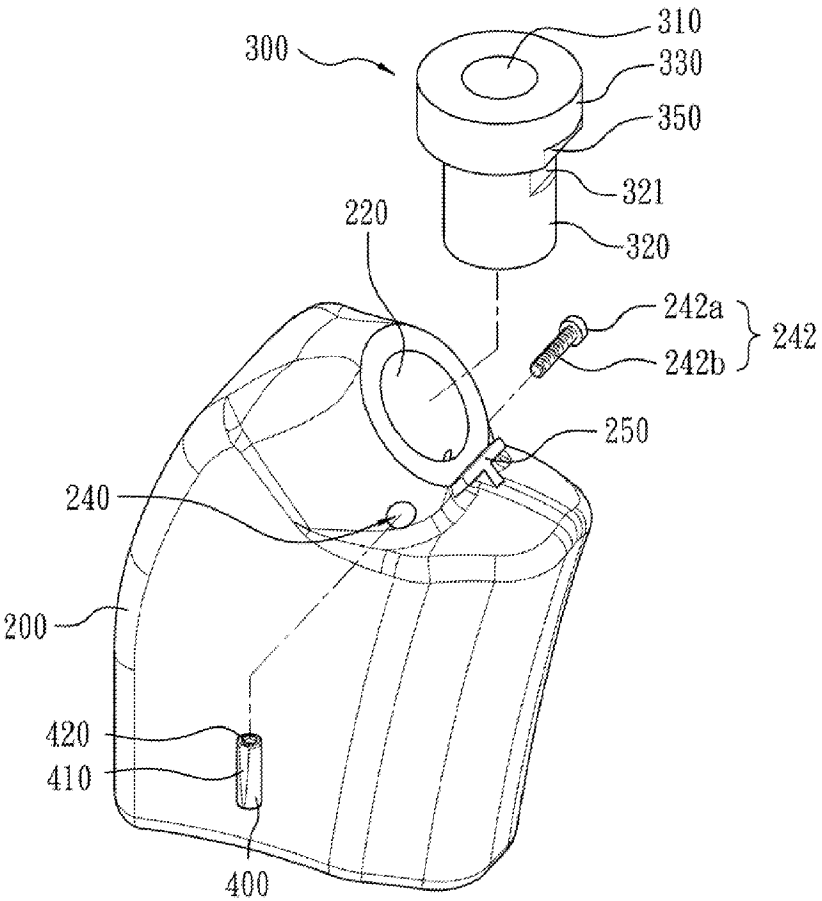
FIG. 7 is an exploded view of the cutting tool holding device shown in FIG. 6.
Figure 8:
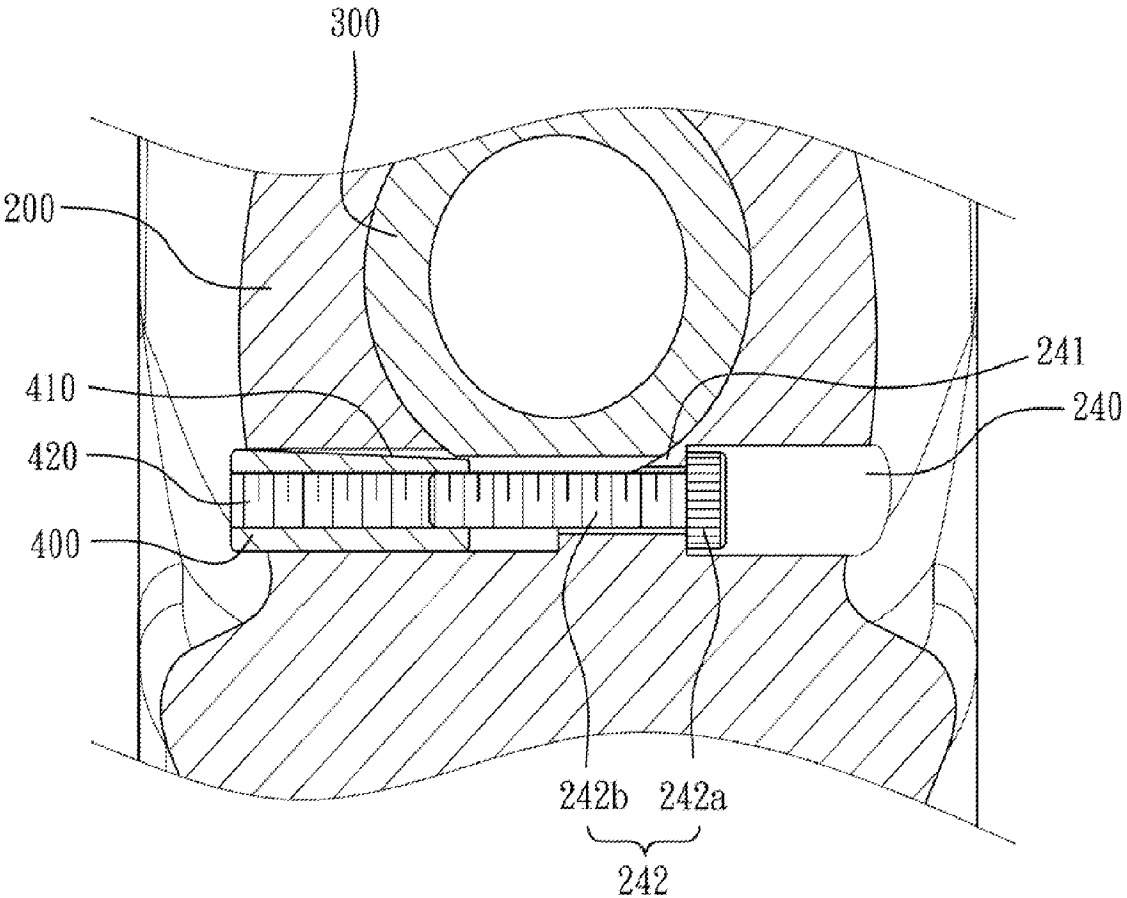
FIG. 8 is a partial cross-sectional view of the cutting tool holding device along line 8-8 shown in FIG. 6.
Figure 9:
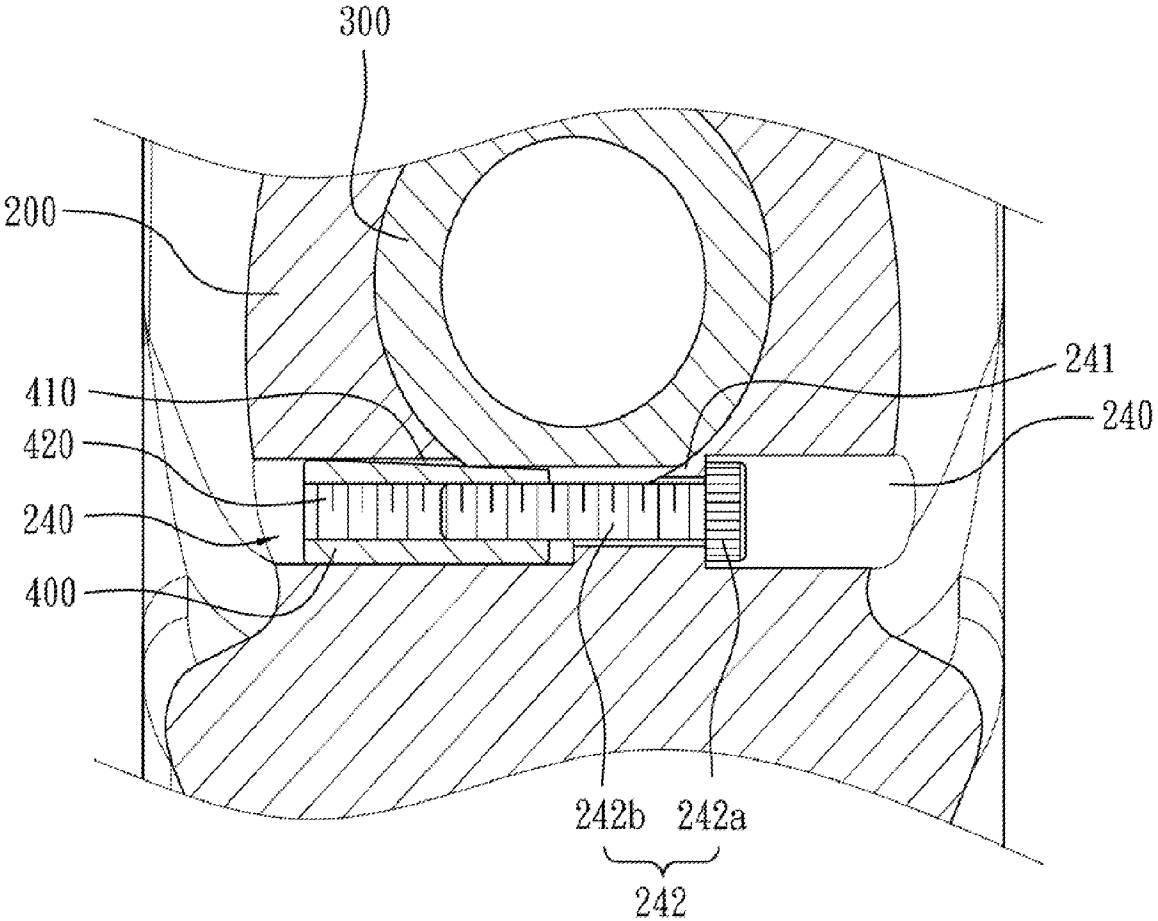
FIG. 9 is another partial cross-sectional view of the cutting tool holding device along line 8-8 shown in FIG. 6.

FIG. 6 is a perspective view of a cuffing tool holding device 100 according to another embodiment of the present disclosure. FIG. 7 is an exploded view of the cutting tool holding device 100 shown in FIG. 6. FIG. 8 is a partial cross-sectional view of the cutting tool holding device 100 along line 8-8 shown in FIG. 6. FIG. 9 is another partial cross-sectional view of the cutting tool holding device 100 along line 8-8 shown in FIG. 6. An indentation 350 is formed on the step portion 330 of the positioning tube 300, and a protruding portion 250 is disposed on the base 200 corresponding to the indentation 350. The protruding portion 250 is engaged with the indentation 350, whereby the positioning tube 300 is positioned in the base 200 without rotating around.

The through hole 240 of the base 200 is substantially circular, and a narrow portion 241 and a screw member 242 (shown in FIG. 8 and FIG. 9) are disposed in the through hole 240. The screw member 242 has a head 242*a* and a threaded body 242*b*. The head 242*a* is located at an end of the narrow portion 241, and the threaded body 242*b* inserts through the narrow portion 241 and protrudes from the other end of the narrow portion 241. A radial dimension of the head 242*a* is greater than a radial dimension of the through hole 240 at the narrow portion 241. Therefore, the head 242*a* is not allowed to move to the other end of the narrow portion 241, and a position of the screw member 242 is confined thereby. The positioning member 400 is substantially formed in a tube shape corresponding to the through hole 240. An inclined plane 410 is disposed on an outer surface of the positioning member 400, whereby the positioning member 400 has a cross-sectional area changing gradually along an extending direction thereof. Furthermore, a tightening thread 420 is disposed on an inner surface of the positioning member 400 for engaging with the threaded body 242*b* of the screw member 242, whereby the positioning member 400 can be driven by the screw member 242 for changing a pressing degree between the inclined plane 410 and the positioning tube 300. As shown in FIG. 8 and FIG. 9, the pressing degree between the inclined plane 410 and the positioning tube 300 increases as the positioning member 400 moves into the through hole 240. Therefore, the load value of the base 200 and the load value of positioning tube 300 for the reaction force generated by the cutting tool A can be enhanced, and the displacement of the base 200 caused by the reaction force can be avoided, too.

Figure 10:
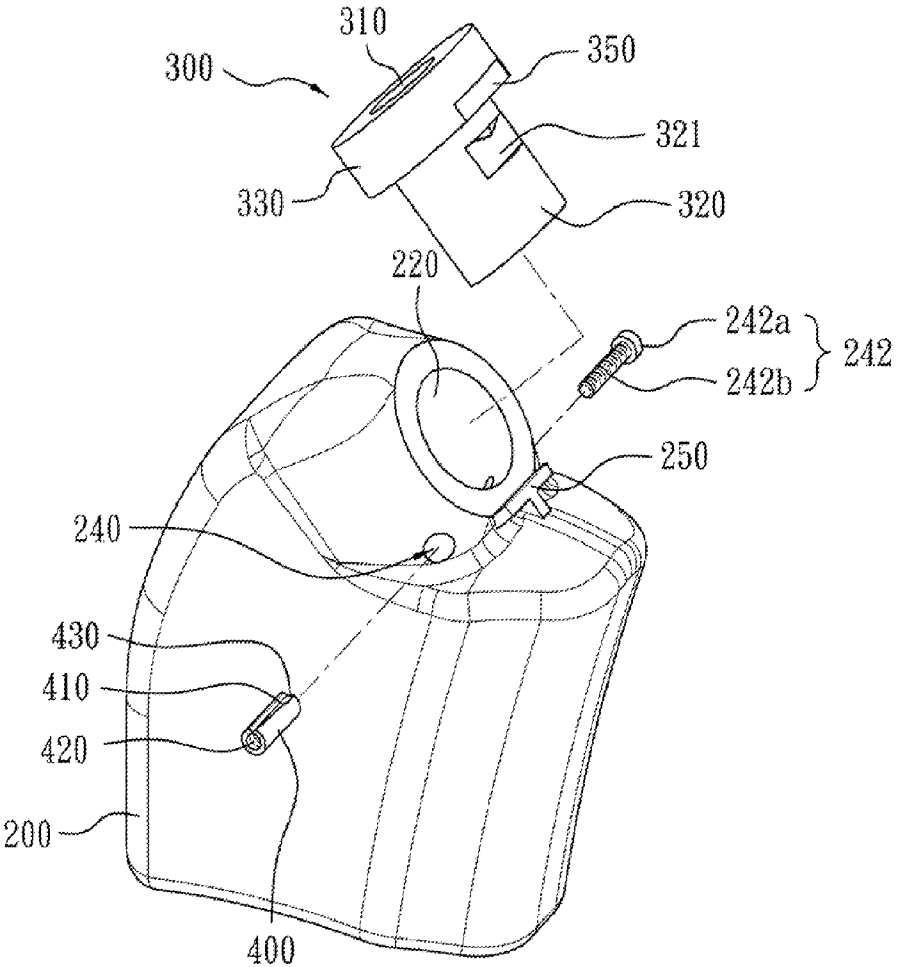
FIG. 10 is an exploded view of a cutting tool holding device according to yet another embodiment of the present disclosure.

FIG. 10 is an exploded view of a cutting tool holding device 100 according to yet another embodiment of the present disclosure. In FIG. 10, the through hole 240 of the base 200 is substantially circular, and the screw member 242 is disposed in one end of the through hole 240. The screw member 242 has the head 242*a* and the threaded body 242*b*.

Figure 11:
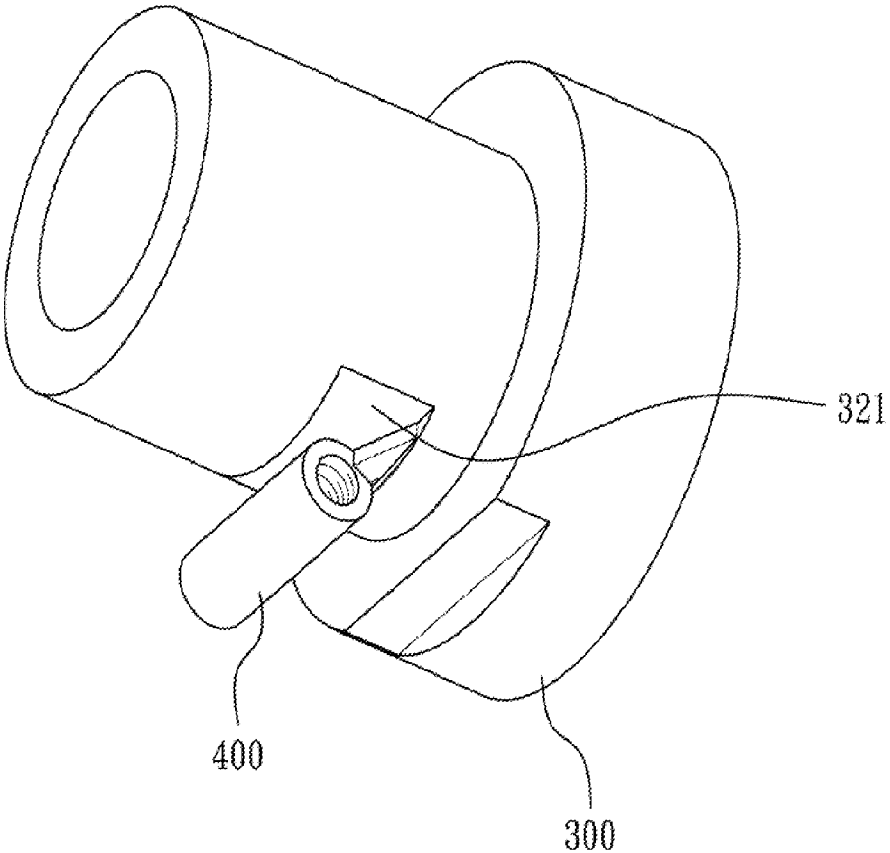
FIG. 11 is a perspective view showing a combining state of a positioning tube and a positioning member shown in FIG. 10.
Figure 12:
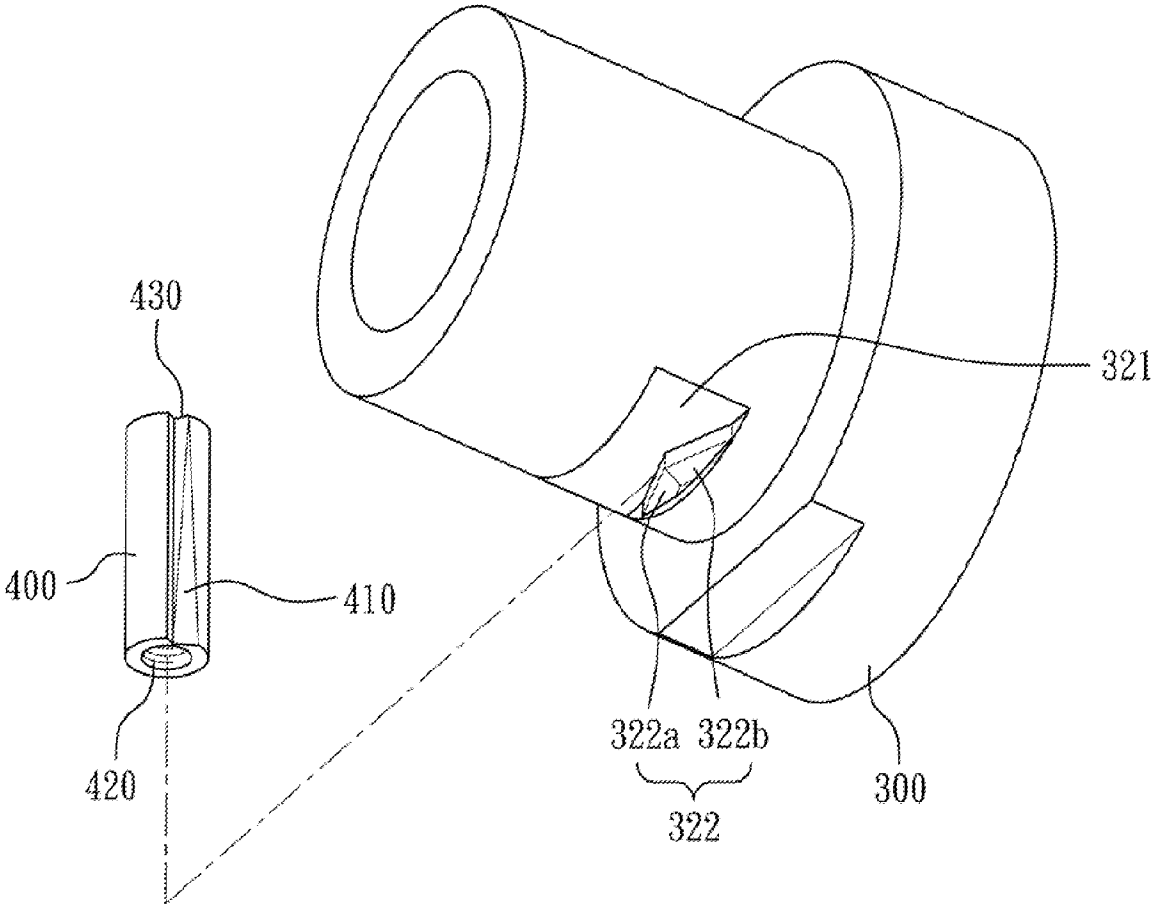
FIG. 12 is an exploded view of the positioning tube and the positioning member shown in FIG. 11.
Figure 13:
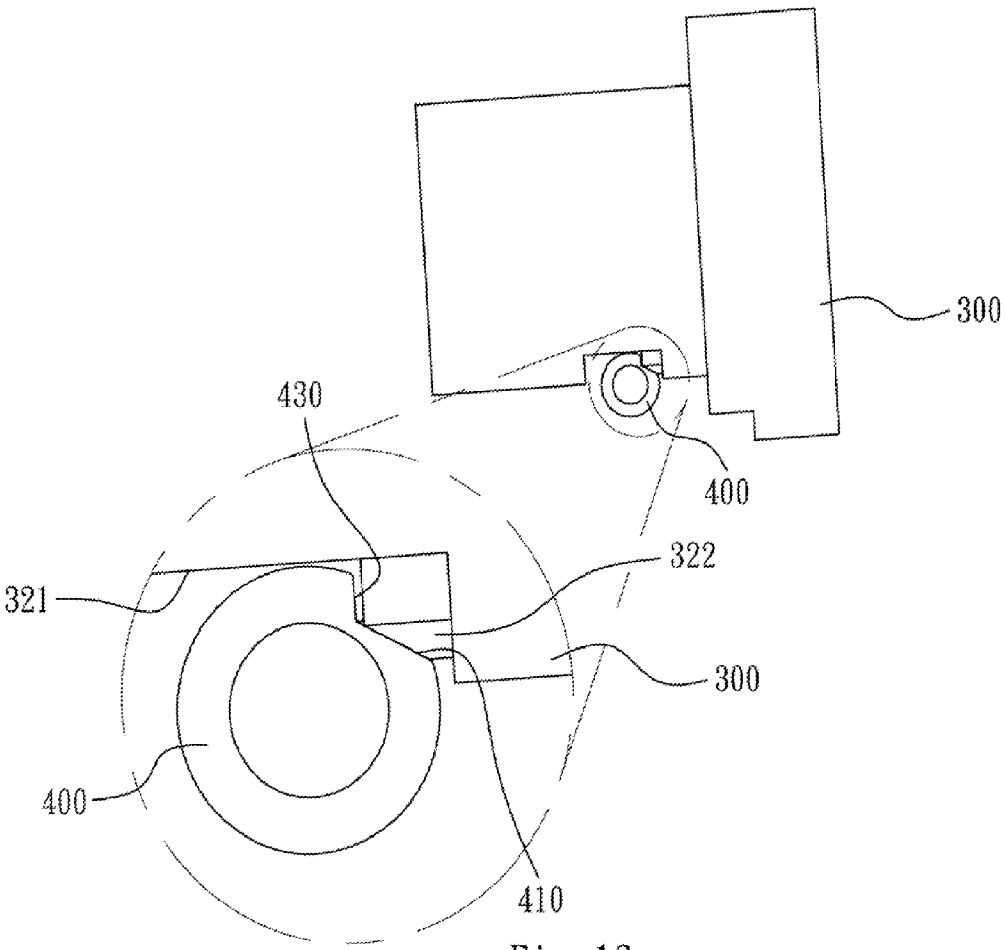
FIG. 13 is a side view of the positioning tube and the positioning member shown in FIG. 11.

FIG. 11 is a perspective view showing a combining state of the positioning tube 300 and the positioning member 400 shown in FIG. 10. FIG. 12 is an exploded view of the positioning tube 300 and the positioning member 400 shown in FIG. 11. FIG. 13 is a side view of the positioning tube 300 and the positioning member 400 shown in FIG. 11. A ridge portion 322 is disposed in the limiting groove 321 of the positioning tube 300. The ridge portion 322 has a first surface 322*a* and a second surface 322*b*. The first surface 322*a* and the second surface 322*b* are sloping symmetrically. The positioning member 400 is substantially formed in a tube shape corresponding to the through hole 240, and is inserted into the through hole 240 from the other end of the through hole 240. A positioning groove 430 having the inclined plane 410 is disposed on an outside of the positioning member 400, whereby the positioning member 400 has the cross-sectional area changing gradually along the extending direction thereof. In the embodiment, the inclined plane 410 is substantially triangular. The positioning groove 430 corresponds to the ridge portion 322, and the inclined plane 410 corresponds to and abuts against the first surface 322*a*. Furthermore, a tightening thread 420 is disposed on the inner surface of the positioning member 400 for engaging with the threaded body 242*b* of the screw member 242, whereby the positioning member 400 is driven by the screw member 242 for changing the pressing degree between the inclined plane 410 and the positioning tube 300. As a result, the load value of the base 200 and the load value of positioning tube 300 for the reaction force generated by the cutting tool A can be enhanced, and the displacement of the base 200 caused by the reaction force can be avoided, too.

According to the foregoing embodiment, the cutting tool holding device according to the disclosure has advantages as follows.

First, when the press member is disposed on the positioning tube and the axial pressing groove is disposed in the base corresponding to the press member, the rotating movement of the positioning tube in the base can be avoided, and the assembling stability between the base and the positioning tube can be reinforced accordingly. Therefore, the load value of the base and the load value of the positioning tube for the reaction force generated by the cutting tool A can be enhanced, and the maintenance cost of the cutting tool holding device can be reduced.

Second, the cross-sectional area of the pressing member reducing gradually from the inner side of the pressing member to the outer side of the pressing member or the cross-sectional area of the axial pressing groove reducing gradually from the outer side of the axial pressing groove to the inner side of the axial pressing groove both can reinforce the tightening extent between the positioning tube and the base.

Third, when the indentation is formed on the end of the positioning tube and the protruding portion is disposed on the base corresponding to the indentation, the protruding portion is engaged with the indentation, whereby the positioning tube is positioned in the base without rotating around. The assembling stability between the base and the positioning tube can be reinforced accordingly. Therefore, the load value of the base and the load value of the positioning tube for the reaction force generated by the cutting tool A can be enhanced, and the maintenance cost of the cutting tool holding device can be reduced.

Fourth, when the positioning member is the C-shaped elastic tube, the positioning member 400 presses against the limiting groove of the positioning tube due to the expanding elasticity generated from the positioning member. The assembling stability between the base and the positioning tube can be further reinforced.

Fifth, when the cross-sectional area of the positioning member changes gradually along the extending direction thereof, the tightening extent between the positioning member and the positioning tube can be increased gradually. The assembling stability between the base and the positioning tube can be further reinforced.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A cutting tool holding device, comprising:

a base, comprising:

a mounting hole; and a through hole formed at a side of the mounting hole and communicated with the mounting hole, wherein the through hole of the base is substantially circular, a screw member is disposed in one end of the through hole, and the screw member has a head and a threaded body;

a positioning tube, comprising:

an axial receiving hole formed within the positioning tube for receiving a cutting tool;

an accommodated portion disposed at an end of the positioning tube for being installed into the mounting hole;

a limiting groove formed on a side of the accommodated portion; and a ridge portion disposed in the limiting groove of the positioning tube and having a first surface; and a positioning member positioned in the through hole of the base, wherein the positioning member abuts against the limiting groove of the positioning tube, the positioning member has a cross-sectional area changing gradually along an extending direction thereof which is configured for pressing the positioning tube, the positioning member is substantially formed in a tube shape corresponding to the through hole and is inserted into the through hole from the other end of the through hole, a positioning groove having an inclined plane is disposed on an outside of the positioning member, the positioning groove corresponds to the ridge portion, the inclined plane corresponds to and abuts against the first surface, a tightening thread is disposed on an inner surface of the positioning member for engaging with the threaded body of the screw member, whereby the positioning member is driven by the screw member for changing a pressing degree between the inclined plane and the positioning tube.

2. The cutting tool holding device of claim 1, wherein:

the base further comprises a first wall and a second wall, the second wall has a mounting surface, and the mounting hole is formed at the mounting surface; and the positioning tube further comprises a step portion disposed at an outside of the positioning tube, and the step portion abuts against the mounting surface.

3. The cutting tool holding device of claim 1, wherein:

the base further comprises an axial pressing groove disposed at a side of the mounting hole opposing to the through hole; and the positioning tube further comprises a pressing member formed on a side of the accommodated portion opposing to the limiting groove, the pressing member is engaged with the axial pressing groove, whereby the positioning tube is positioned in the base without rotating around.

4. The cutting tool holding device of claim 3, wherein:

the axial pressing groove is formed in a V-shape; and the pressing member is a triangular column corresponding to the axial pressing groove.

5. The cutting tool holding device of claim 3, wherein:

the axial pressing groove is formed in a U-shape; and the pressing member is a half cylinder corresponding to the axial pressing groove.

6. The cutting tool holding device of claim 3, wherein:

the axial pressing groove is formed in a dovetail shape; and the pressing member is a dovetail column corresponding to the axial pressing groove.

7. The cutting tool holding device of claim 3, wherein the pressing member has a cross-sectional area reducing gradually from an inner side of the pressing member to an outer side of the pressing member.

8. The cutting tool holding device of claim 3, wherein the axial pressing groove has a cross-sectional area reducing gradually from an outer side of the axial pressing groove to an inner side of the axial pressing groove.

9. The cutting tool holding device of claim 3, wherein an extending direction of the axial pressing groove is substantially perpendicular to a through direction of the positioning member.

10. The cutting tool holding device of claim 1, wherein:

the positioning tube further comprises an indentation formed on an end of the positioning tube where the cutting tool is fed in; and the base further comprises a protruding portion disposed corresponding to the indentation, the protruding portion is engaged with the indentation, whereby the positioning tube is positioned in the base without rotating around.

* * * * *